US005310644A

United States Patent [19]

Delton

[11] Patent Number: 5,310,644

[45] Date of Patent: May 10, 1994

[54] PROCESS FOR PREPARING A PHOTOGRAPHIC EMULSION USING EXCESS HALIDE DURING NUCLEATION

[75] Inventor: Mary H. Delton, Honeoye Falls, N.Y.

[73] Assignee: Eastman Kodak Company, Rochester, N.Y.

[21] Appl. No.: 761,319

[22] Filed: Sep. 17, 1991

[51] Int. Cl.[5] ..... G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 3,885,970 | 5/1975 | Miyahara | 430/567 |
| 4,075,020 | 2/1978 | Saleck et al. | 430/569 |
| 4,147,551 | 4/1979 | Finnicum et al. | 430/567 |
| 4,150,994 | 4/1979 | Maternaghan | 430/567 |
| 4,241,173 | 12/1980 | Saleck et al. | 430/569 |
| 4,400,463 | 8/1983 | Maskasky | 430/434 |
| 4,434,226 | 2/1984 | Wilgus et al. | 430/567 |
| 4,439,520 | 3/1984 | Kofron et al. | 430/434 |
| 4,713,323 | 12/1987 | Maskasky | 430/569 |
| 4,783,398 | 11/1988 | Takada et al. | 430/567 |
| 4,914,014 | 4/1990 | Daubendiek et al. | 430/569 |
| 4,945,037 | 7/1990 | Saitou | 430/567 |
| 5,120,638 | 6/1992 | Schmidt et al. | 430/567 |

FOREIGN PATENT DOCUMENTS

| | | |
|---|---|---|
| 0302528 | 2/1989 | European Pat. Off. . |
| 421426 | 4/1991 | European Pat. Off. . |
| 421740 | 4/1991 | European Pat. Off. . |

OTHER PUBLICATIONS

James, The Theory of the Photographic Process, 4th Ed., pp. 21-22, 1977.

Berry et al., Photographic Science and Engineering, vol. 6, No. 3, Jun., 1962, pp. 159-165.

Japanese Abstract for "Silver Halide Photographic Sensitive Material", Publication No. JP-A-2-024643, published Jan. 1990.

Japanese Abstract for "Silver Halide Photographic Emulsion", Publication No. JP-A-2-298935, published Dec. 1990.

*Primary Examiner*—Charles L. Bowers, Jr.
*Assistant Examiner*—John A. McPherson
*Attorney, Agent, or Firm*—Paul A. Leipold

[57] ABSTRACT

A process for preparing a photographic emulsion involves an initial nucleation step of reacting a first silver salt with a bromide in the presence of a first excess halide under conditions effective to nucleate AgBr crystals. The nuclei are then grown to form photosensitive grains by addition of a second silver salt and a second halide as growth salts. If excess chloride is used during nucleation, even without excess bromide and/or a growth modifier, the nuclei formed have twin planes, and the pAg level can be used to control the aspect ratio of the tabular grains obtained. If a relatively high silver concentration in the growth solution is maintained throughout the growth step, the resulting grains have a unique, twinned cubooctahedral or cubooctahedral-tabular shape. Unique tabular grains having alternating 1.1.1 and 1.0.0 edge faces can be formed by this process.

37 Claims, 2 Drawing Sheets

PROCESS FOR PREPARING A PHOTOGRAPHIC EMULSION USING EXCESS HALIDE DURING NUCLEATION

TECHNICAL FIELD

This invention relates to processes for the preparation of silver halide emulsions useful in preparing photosensitive films, and to new forms of silver halide grains produced by such processes.

BACKGROUND OF THE INVENTION

Photographic film quality is directly related to the grain properties of the silver halide emulsion. Grain properties affect sharpness, granularity, chemical and spectral sensitization, pressure sensitivity, contrast, speed, developability, and other characteristics of the film. Silver halide grains having cubic, octahedral, cubooctahedral and tabular forms are all well known and have been used in photosensitive emulsions.

Single and double twinning has been known to occur in a number of known silver halide crystal shapes. See generally James, *The Theory of the Photographic Process*, 4th Ed., pages 21–22. Berry et al., *Photographic Science and Engineering*, Vol. 6, No. 3, June 1962 pages 159–165 describe doubly twinned cubic grains and speculate as to the existence of doubly-twinned cubooctahedral grains (at page 162). As illustrated in FIG. 1.9 of James, known double-twinned tabular grains have a ridge-trough edge structure.

Many methods have been proposed for producing thin tabular grains of intermediate or high aspect ratio. See, for example, Takada et al., U.S. Pat. No. 4,783,398 issued Nov. 8, 1988, wherein a growth modifier is used during nucleation and growth to produce a tabular grain having a 50–90 mole % content of chloride and an aspect ratio between 2:1 and 10:1. Maskasky, U.S. Pat. No. 4,400,463 issued Aug. 23, 1983, describes hexagonal and dodecahedral tabular grains with ridge-trough edge structures. Maskasky U.S. Pat. No. 4,713,323 issued Dec. 15, 1987 uses a large excess of chloride (0.5 molar $CaCl_2$) and a growth modifier at nucleation and during growth to provide tabular grains with aspect ratios of 8:1 to greater than 12:1. In Daubendiek et al., U.S. Pat. No. 4,914,014 issued Apr. 3, 1990, a thin tabular grain silver bromide or bromoiodide emulsion is precipitated using excess bromide at the nucleation stage. A large stoichiometic excess of bromide is also recommended in Wilgus U.S. Pat. No. 4,434,226 and Kofron U.S. Pat. No. 4,439,520.

Double-twinned tabular grains have been prepared in a variety of forms. See, for example, Saitou U.S. Pat. No. 4,945,037, which describes tabular grains wherein the center and outer portions of the grain contain different mole percent amounts of iodide. Grains having both 1.1.1 and 1.0.0 planes are mentioned; see also Konica European Patent Publication Nos. 421,740 and 421,426. A commonly-assigned application by Jagannathan et al. entitled HIGH EDGE CUBICITY TABULAR GRAIN EMULSIONS describes AgBr and AgBrI tabular grains wherein less than 75% of the edge surfaces lie in 1.1.1 crystallographic planes.

A variety of methods for preparing photographic emulsions have involved using two or more different halide salts. Saleck et al., U.S. Pat. No. 4,075,020 issued Feb. 21, 1978, describes a halide converted emulsion made by continuous conversion of a more soluble silver halide into a less soluble silver halide. Finnicum et al., U.S. Pat. No. 4,147,551 issued Apr. 3, 1979, discloses a halide converted emulsion process which produces cubic and mixed crystal silver halide grains. Typical halide conversions produce amorphous grains and are unable to produce the more preferred tabular grains which exhibit superior photographic qualities. Saleck et al., U.S. Pat. No. 4,241,173 issued Dec. 23, 1980, reports a process where silver halide is precipitated in a large (50 mole %) excess of chloride under equilibrium conditions and without a separate nucleation step.

Despite these recent advances, a need remains for methods capable of controlling the aspect ratio of silver halide tabular grains, and also for preparing new twinned grain shapes. The present invention addresses these needs.

SUMMARY OF THE INVENTION

A process for preparing a photographic emulsion according to the invention involves an initial nucleation step in the presence of an excess halide, followed by a growth step wherein the nuclei are enlarged to form photosensitive grains. In particular, the nucleation step involves reacting a first silver salt with a bromide in the presence of a first, excess halide under conditions effective to nucleate essentially pure twinned AgBr crystals. The nuclei are then grown to form photosensitive grains by addition of a second silver salt and a second halide.

According to one aspect of the invention, chloride is the excess halide used during nucleation, i.e., as the reaction between initial small quantities of the silver salt and the bromide proceeds, and the resulting grains are tabular. The chloride level during nucleation and growth is adjusted to control the aspect ratio of the tabular grains obtained once growth is completed. In particular, chloride may be used as the only excess halide in the nucleation kettle to promote twinning, yielding tabular grains wherein greater than about 70% of the total surface area of the grains is tabular and providing higher edge cubicity (% EC) than when Cl is absent. For this purpose, when Cl is the excess ion during nucleation, pAg at nucleation is preferably about 8 or less at 35° C. when measured with a bromide plated silver electrode. This pAg limit will vary somewhat depending on the temperature and nature of the measuring electrode. Thus, all pAg limitations as expressed herein should be understood to include equivalent pAg amounts for obtaining the desired results under different conditions.

If bromide is used as the excess ion in the nucleation kettle and the amount of bromide is adjusted to give a pAg of 8 or less, one does not obtain grains with more than 70% tabular surface area (compare Samples 1 and 2 in the Examples below.) Instead, the grains are a mixture of grain types (rods, irregular, tabular, etc.)

Tabular grains with a tabularity (T) greater than 25 grown at pAg>7.5, particularly 8.5, using Cl as the excess ion during nucleation, with or without chloride added during growth, contain little or no Cl in the final tabular grains. T is defined as $D/t^2$, wherein D is diameter or equivalent circular diameter (ECD) and t is the measured grain thickness. However, the percent edge cubicity (% EC) of these grains is generally larger than that of tabular grains made without using excess chloride in the nucleation kettle (compare Samples 4 and 12 and Table 1B, below.) As is known in the art, total cubicity (% C) refers to the percent of cubic surfaces relative to the total surface of the grain, and % EC to the portion of the edge surfaces that are cubic surfaces.

According to another aspect of the invention, a relatively high silver concentration (pAg 8.1 or less) in the growth solution is maintained for at least about 98% of the growth step. Unique tabular grains having 1.0.0 as well as 1.1.1 edge faces have been formed by this process. Specifically, with excess chloride or bromide in the nucleation kettle and using a growth pAg of 8 or less as measured at 60° C. for about 87 to 100% of the total silver precipitated in the grains, one can precipitate two new types of grain morphologies, cubooctahedral tabular (COT) and twinned cubooctahedral (TCO). For COT grains, T is less than about 25, and % EC is in the range of about 19 to 70% of the total edge surface area. For TCO grains, T is less than about 1. Chloride used in precipitation of these new grain types is incorporated into the final grains. This is advantageous insofar as chloride provides more rapid development.

Grains of the new morphologies can be obtained under several different conditions. Pregrowth Cl and Br concentrations, growth Cl concentration, growth silver addition rate (moles Ag/minute), and the percent iodide incorporated in the grains during growth can all be varied, as demonstrated in the examples below, to yield COT or TCO grains having compositions including AgBr, AgBrI, AgBrCl, or AgBrClI. For example, when the excess ion during nucleation is Cl and a pAg level of 8.1 or less is maintained for greater than about 46% of grain growth, the resulting grains are COT or TCO. When Br is the excess ion, the initial growth pAg for obtaining TCO or COT grains may be greater than 8.75. However, after 6 to 50% of the total silver is precipitated, pAg is lowered to 7.8 or less (see Samples 32–35.) Thus, exact parameters for formation of COT and TCO grains vary depending on the materials and reaction conditions of the precipitation, and the general limitation that pAg is about 8 or less referred to above should be understood to allow for such variations.

Accordingly, one process of the invention for preparing a photographic emulsion includes the steps of (A) reacting a first silver salt with a bromide in the presence of a first, excess halide under conditions effective to nucleate AgBr crystals having double, parallel twin planes, the first halide remaining in solution, and then (B) growing the crystals in an aqueous solution to form photosensitive grains by addition of a second silver salt and a second halide while maintaining a silver concentration in the growth solution sufficiently high to produce TCO or COT grains having 1.1.1 and 1.0.0 edge structure. The invention further provides new forms of silver halide grains as described above, together with photosensitive elements containing such grains.

DETAILED DESCRIPTION

Figure 1:
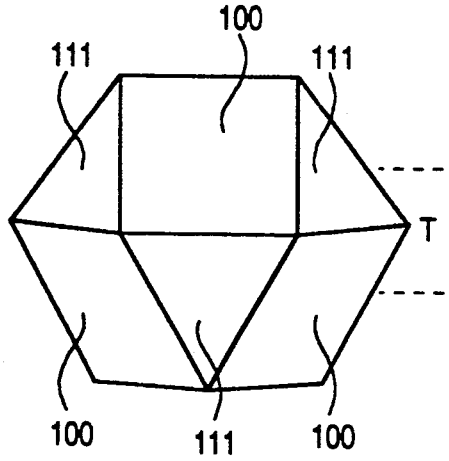
FIG. 1 is a side view of an even-twinned TCO grain according to the invention.

The process for preparing a photographic emulsion according to the invention begins with a nucleation step in which fine crystals of a silver halide, such as silver bromide, are precipitated in the presence of excess halide. According to one aspect of the invention, silver bromide nuclei are formed in the presence of a relatively large amount of an excess halide, preferably chloride. The amount of excess halide is from 1 to 8 times, preferably 2–4 times the molar amount of bromide being nucleated. The amount of total silver involved in nucleation is quite small, i.e., preferably about 1 mole % or less of the total silver added in the process as a whole. A separate nucleation step allows a large number of fine nuclei to form, as opposed to a smaller number of larger grains as may form in a one-step precipitation process. A brief delay, such as at least about 2 minutes, between nucleation and the subsequent growth, is needed for successful nucleation. This transitional period can also serve other purposes as described below.

According to a preferred embodiment of the invention, nucleation begins with a step of forming an aqueous solution containing an acid, a peptizing medium, and a chloride or bromide salt as the excess halide in an amount effective to obtain a pCl of 3 or less, typically from 1 to 2, especially 1.6 to 1.9, or pBr of 2 or less. Greater pCl or pBr values have been found to yield poorer results. The acid, such as sulfuric acid, provides the selected pH level, preferably 6 or less, especially 1.8–2.5 to provide good gel complexing properties, and the peptizing medium (e.g., gelatin) allows uniform nucleation to proceed. The mixture is heated to a temperature suitable for nucleation, generally from 35° C. to 60° C. A silver salt and a bromide salt are then added to the mixture, by single or double jet addition, to form the silver halide nuclei, and the reaction is allowed to proceed for a time sufficient to allow substantially pure AgBr nuclei to form. The amount of bromide is preferably less than an excess amount relative to silver, and preferably equimolar to the amount of silver.

The silver salt used in nucleation and growth is commonly $AgNO_3$, although other silver salts which do not interfere with the reaction could be used. Similarly, the bromides, chlorides and iodides used in nucleation, transition and growth are usually sodium salts (NaI, NaCl, NaBr), but other salts such as potassium, cesium, calcium, and ammonium salts of chlorine, bromine, and iodine, and combinations thereof could be used.

The amount of excess halide present during nucleation must be sufficient to cause the formation of parallel twin planes. Amounts in the range from 0.35 g/l to 2.5 g/l (pCl=2.22 to 1.37) of chloride are most preferred. However, a large excess of chloride would prevent the unique results according to the invention from being obtained.

One surprising aspect of the invention is that excess chloride, which does not react directly with the silver salt, nonetheless changes the nature of the crystals formed in a nucleation kettle which does not contain any excess bromide or growth modifier. Previously, excess bromide or excess chloride with a growth modifier (Maskasky et al., cited above) were thought to be the necessary conditions to obtain parallel, double-twinned AgCl or AgBrCl grains.

The silver ion concentration in the solution at the end of nucleation is not critical and can range from pAg 8.4 or higher, most commonly pAg 9.6 to 8.4. However, the pAg level maintained during growth affects the size and shape of the resulting grains. Thus, in the transitional period between nucleation and growth, several steps are generally taken to prepare for the growth step. First, since growth is commonly conducted at a higher temperature than nucleation, the mixture containing the nuclei is heated to the selected growth temperature before the growth step begins. Any additional quantities of salts, such as NaBr or NaCl, may be dumped into the mixture all at once or by metered addition. Bromide addition directly affects pAg by taking free silver out of solution, and may thus be used to adjust pAg. If pAg is too high at the end of nucleation, indicating not enough silver in solution, silver ions may be added directly to the solution to lower pAg. Additional gelatin can also be added at this stage. The duration of transition is generally at least 10 minutes if nucleation and growth are conducted at different temperatures. If nucleation and growth are conducted at the same temperature, the transition period can be short, for example, as little as two minutes.

During growth, a second quantity of a silver salt comprising a majority of the silver is added at the same time as additional halide(s), generally in equimolar amounts. Growth is preferably carried out at a temperature in the range of about 45° C. to 75° C. and a pH of from 2 to less than 7. The pH can be maintained at a desired level by any suitable means, such as adding additional acid or base. The silver salt and halide salt(s) are added gradually, generally in metered additions, to allow uniform grain growth by enlargement of the silver bromide nuclei originally present in the mixture. The duration of the growth step is not critical, but usually varies from 30 to 70 minutes.

After the addition of the growth salts is complete, the resulting photosensitive emulsion can be isolated by flocculation as is known in the art. Additional medium (gelatin) may be added, and pAg and pH may be adjusted, e.g., by addition of acid, base, halide and/or silver, to desired levels while the emulsion is maintained at an elevated temperature at which the emulsion remains flowable.

The emulsion can then be immediately coated on a support, or chilled and stored for later use. Suitable supports include cellulose esters, acetates or acetobutyrates, polyesters, polycarbonates, paper, glass or metal. Various coating techniques including dip coating, air knife coating, curtain coating and extrusion coating may be used. Other conventional coating addenda may be used in the preparation of the emulsion, such as surfactants, hardeners, and plasticizers.

According to a preferred aspect of the invention, the silver concentration at the end of transition and beginning of growth is maintained at a substantially constant level, or within a predetermined range, throughout the growth step. Such control can be maintained by controlling the rate at which the silver salt and halide are added. According to another aspect of the invention (see Samples 18 and 32–35 below), the silver concentration at the beginning of growth is maintained for only a time period sufficient to allow from about 2.5 to 46 mole % of the silver to be precipitated. Then the silver concentration is adjusted to the desired concentration for the remainder of the growth step as needed to obtain the new grain types (TCO and COT).

As demonstrated in Example 1 below, silver concentration as reflected by pAg level during growth can be used to control the aspect ratio of the tabular grains obtained. If growth pAg is higher than 8.5, particularly in the range of about 9.2 down to 8.5, the resulting tabular grains have a high aspect ratio greater than 20:1. For pAg levels from 8.5 down to 7.9, the tabular grain aspect ratio ranges from about 5:1 to 20:1. Finally, if pAg is about 7.9 or less, preferably 7.9 to 7.4, low aspect ratio tabular grains (5:1 or less) are obtained. These low aspect ratio grains contain all of the chloride originally present in solution, as well as chloride added during growth up to a maximum of about 15% chloride, and thus comprise AgClBr or AgClBrI grains. The high aspect grains are essentially chloride free, and the medium aspect grains contain intermediate amounts of chloride.

Figure 4:
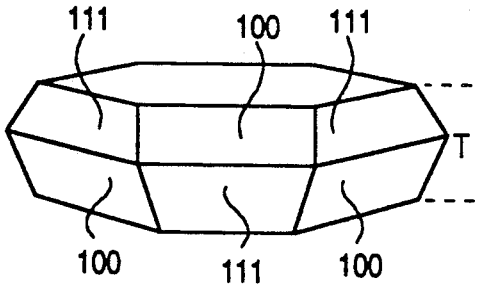
FIG. 4 is a side view of an even-twinned COT grain according to the invention.
Figure 5:
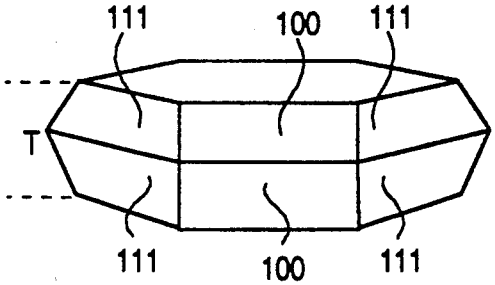
FIG. 5 is a side view of an odd-twinned COT grain according to the invention.

The pAg level during growth can also produce the new grain morphologies according to the invention. This has been shown for both chloride and bromide as the excess halide. If pAg is maintained at a value of about 8.1 or less, particularly 7.9 to 7.4, the final grain morphology is either twinned cubooctahedral (TCO) or twinned cubooctahedral-tabular (COT). The latter are different from known twinned tabular grains in that the COT grains of the invention have an edge structure composed of alternating 1.1.1 and 1.0.0 surfaces as shown in FIGS. 4 and 5, whereas known twinned tabular grains have an edge structure of only 1.1.1 crystal surfaces or have a different composition.

Figure 3:
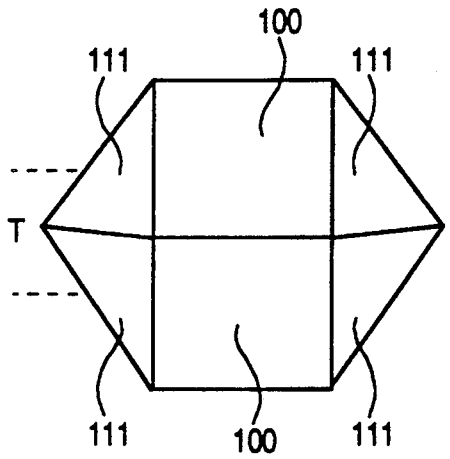
FIG. 3 is a side view of an odd-twinned TCO grain according to the invention.
Figure 2:
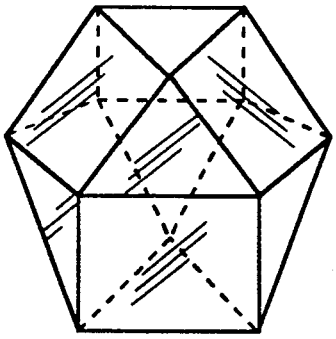
FIG. 2 is a three-dimensional end view of the TCO grain of FIG. 1, with concealed faces shown by dotted lines.

The drawings illustrate the TCO and COT grains according to the invention. In FIGS. 1, 3, 4 and 5, T designates the twin plane region, 100 designates a 1.0.0 plane, and 111 designates a 1.1.1 plane. The COT grains according to the invention (FIGS. 4 and 5) have both 1.0.0 and 1.1.1 faces, with aspect ratios of from about 2 to 8, and are essentially central slices or truncated forms of the twinned cubooctahedral grains, as depicted in FIGS. 1–3.

Figure 6:
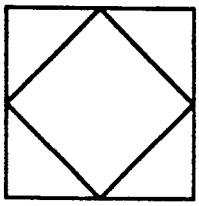
FIG. 6 is a top view of the even-twinned TCO grain of FIG. 2.
Figure 7:
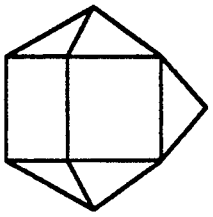
FIGS. 7 and 8 are alternative perspective views of the odd-twinned TCO grain of FIG. 3.
Figure 8:
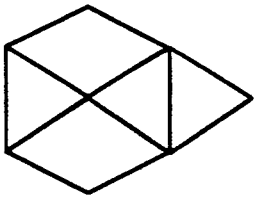
Figure 9:
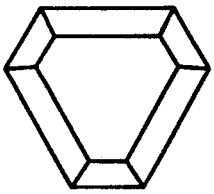
FIG. 9 is a top view of an alternative embodiment of a COT grain according to the invention.
Figure 10:
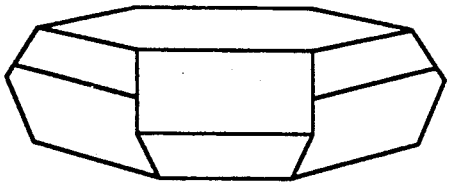
FIG. 10 is a perspective view of an even-twinned COT grain according to the invention, with preferential growth for 1.1.1 surfaces.
Figure 11:
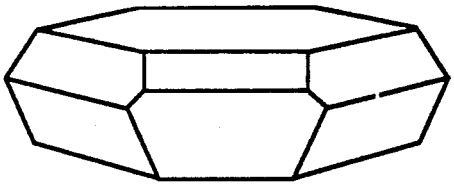
FIG. 11 is a side perspective view of an even-twinned COT grain according to the invention, with preferential growth for 1.0.0 surfaces.

The odd-twinned TCO grain shown in FIG. 3 is not symmetrical. FIGS. 7 and 8 illustrate two other unique views of this crystal shape which have been verified by electron microscopy. FIG. 6 shows another commonly-seen view of an even-twinned TCO grain of the invention, although untwinned cubooctahedra also can present this view. The shapes of the new grains according to the invention can also be varied by altering grain growth conditions. FIGS. 9, 10 and 11 illustrate alternative forms of COT grains of the invention wherein either the 1.1.1 (FIG. 10) or the 1.0.0 (FIG. 11) faces are grown at a faster rate than the other faces.

For purposes of the invention, "cubooctahedral" means that the grains have both 1.1.1 (octahedral) and 1.0.0 (cubic) face surfaces. The different grain morphologies described herein have different amounts of these surfaces as follows:

| MORPHOLOGY | % TOTAL SURFACE AREA 111 | 100 |
|---|---|---|
| Thin tabular | >93 | 0-7 |
| Cubooctahedral tabular | 65-93 | 7-35 |
| Cubooctahedral | 20-65 | 35-80 |
| Cubic | 0-20 | >80 |

The foregoing ranges hold for TCO and COT grains according to the invention having an odd or an even number of twin planes. The edge structure of grains in the thin tabular ranges remains undetermined due to the small size of the edges of these grains. However, it is reasonable to assume that the edge structure is the same as that observed for the COTS.

Using excess Br at nucleation, if pAg at the start of growth is greater than 9 and growth is allowed to proceed at this silver ion concentration, thin tabular grains result. To obtain the novel morphologies of this invention using bromide as the excess ion at nucleation, the growth pAg is preferably adjusted to the range of about 7.5 to 7.6. This may be done by addition of silver ion. If the pAg is adjusted at the end of the transition and before growth is started, the novel TCO grains are obtained (see Samples 37 and 44). If growth is begun at pAg>9 and then, after from 2.5 to 46 mole % of the total silver has been precipitated (Samples 32, 33, 34 and 35), the pAg is adjusted to 7.5 to 7.6, the novel COT grains of the emulsion result. These grains do not contain chloride but may contain iodide.

The rate of growth salt (silver and halide) addition during growth provides a means for controlling the morphology of grains produced. The halide added during growth is usually bromide, but significant quantities of iodide and chloride can also be added together with bromide, and will change the required addition rate. For example, to obtain COT grains according to the invention, representative rates are 0.038 up to 0.056 moles per minute of $Ag+$. A range of from 0.038 to 0.045 mole per minute per liter is preferred if the added halide is from 2 to 6 mole % iodide. Similarly, twinned cubooctahedra are obtained if the growth silver addition rate is at least about 0.056 mole/min in the absence of iodide, or from 0.056 up to 0.100 mole/min if 2-6 mole % iodide is present. In general, for a particular molar addition rate of silver, the greater the amount of chloride or iodide present during growth, the greater the tendency to form COT grains instead of the twinned cubooctahedral grains.

Each of the types of grains made according to the invention can be shown, by cross-sectioning, to have twin planes. The oddly twinned cubooctahedra of the invention have been clearly identified in scanning electron microscopy by observation of the unique projection in which either two 1.1.1 or two 1.0.0 planes share a common edge (FIGS. 3, 7 and 8.) This is the first proven example of twinned cubooctahedra. Both the oddly and evenly twinned cubooctahedra have been clearly demonstrated by cross-sectioning to have single or double parallel twin planes and, in some cases, three parallel twin planes.

The precipitation techniques of the invention can produce grains with unique morphologies. These grains have predominantly double, parallel twin planes and may be high aspect tabular grains, low aspect cubooctahedral tabular grains or twinned cubooctahedra. The process of the invention allows grains having parallel twin planes to be formed using a different excess halide than used in prior processes, and allows a choice of morphologies which can be readily made by controlling silver as well as halide levels during nucleation and growth.

The process of the invention further provides a unique method for AgBr nucleation in the presence only of excess chloride. This causes the amount of silver in solution during nucleation to remain relatively high (pAg<8.7, especially pAg from 8.0 to 6.5).

The TCO and COT grains of the invention can be used in any standard photographic element in either negative or reversal format. Further, such new morphologies can be used with differential sensitization, wherein a chemical sensitizer is used on one type of surface (either 1.1.1 or 1.0.0) and a spectral sensitizer is used on the other surface. See generally European Patent Publication No. 302,528.

The invention is further described in the following experimental examples.

EXAMPLES

A 12 liter kettle was charged with 3200 ml distilled water, 35 ml 2N sulfuric acid, 7.5 g oxidized, non-deionized lime-processed bone gelatin and 1M NaX, the halide salt. The quantity of NaX, which varied with the particular emulsion being precipitated, is given in Tables 1A, 2A and 3A. Forty-four different samples were prepared in all.

Each mixture was stirred at 3600 rpm while being heated to 35° C. The pAg and pH levels for the mixture were determined. Nucleation was then carried out over 12 seconds by double jet addition of 12 ml each of 1.67M $AgNO_3$ and NaBr solutions. This procedure was varied for Sample 23, wherein the NaBr for nucleation was preadded to the solution and the silver salt was then added by single jet addition to demonstrate that double-jet nucleation is not essential for obtaining the morphologies of the invention. The nucleation bromide was in the starting kettle.

Over approximately 21 minutes of transition time following the completion of nucleation, the temperature of the solution containing the AgBr nuclei was raised to 60° C. at a rate of 5 degrees each 3 minutes, the pH was adjusted to 6.0 by addition of NaOH, 50 g of oxidized gelatin in 250 ml distilled water was added, and 1M solutions of pregrowth salts were dumped in amounts as indicated in Tables 1A, 2A and 3A. The identities and amounts of pregrowth dump salts depended on the morphology of the final grain desired. The pH and pAg at the end of transition were recorded.

Samples 2, 4, 13, 17, and 32-35 were controls for purposes of comparison with thin tabular grains. In Sample 2, the amount of bromide added to the kettle (0.00012 moles) was selected to provide approximately the same pAg level during nucleation as 0.04 moles of chloride. The emulsion made under these conditions consisted of a mixture of rods, 3D's, tabular and irregular grains, demonstrating that pAg at nucleation is not the main factor controlling twinning propensity. Sample 4 used no chloride during nucleation, transition or growth. Sample 13 compares with Sample 12. In Sample 13, no chloride was used in Sample 12, wherein chloride was used, % EC was higher. Sample 17 used bromide in an equimolar amount to the chloride used in Sample 21, showing that bromide cannot be simply substituted for chloride to obtain COT's according to the invention. Samples 32-35 demonstrate that bromide can be used in place of chloride to grow COT grains of the invention, provided that growth pAg is adjusted to less than 8 after at least 2.5 mole % of the silver has been precipitated.

The growth profile for addition of the growth salts consisted of a 10 minute constant flow rate followed by a linear ramp to the final molar addition rate. Total growth time was about 50 minutes. Initial molar addition rates varied with the emulsion being precipitated, and are indicated in the tables. The final molar addition rate was 0.091 mole Ag/minute except where indicated in the tables. For Samples 37, 16 and 43, silver ion was added during transition to decrease the pAg for growth to match that of Sample 22.

Growth was controlled at a constant pAg, which usually corresponded to the pAg at the end of the transition time for each individual precipitation. If the final emulsion was to contain iodide, the iodide was introduced during growth in the form of AgI, and was added concurrently with the silver solution. Growth salts used were silver nitrate, and sodium bromide and/or sodium chloride.

Growth conditions were varied for certain samples. For Sample 18, growth started at pAg=8.99. When 46 mole % of the silver was precipitated, the pAg was changed to 7.78. Sample 31 had a growth temperature of 75° C. instead of 60° C. Sample 32 started growth at pAg=9.01. When 2.5 mole % of the silver was precipitated, the pAg was changed to 7.50. Sample 33 started growth at a pAg of 9.01. When 12.6 mole % of the silver was precipitated, the pAg was changed to 7.50. Samples 34 and 35 started growth at a pAg of 9.01. When 6 mole % of the silver was precipitated, the pAg was changed to 7.56.

Final emulsions were isolated by flocculation. After finishing precipitation, the silver halide emulsion thus formed was cooled to 40° C., 0.40 liters of an aqueous solution of 25% phthalated gelatin was added to the emulsion, and then the emulsion was washed twice by the coagulation method described in U.S. Pat. No. 2,614,929. Then, 0.25 liter of an aqueous solution of 30% bone gelatin was added to the emulsion, and the pH and pAg were adjusted to 6.0 and 9.2, respectively at 40° C.

Final grain morphology, composition in mole %, and sizes are set forth in Tables 1B, 2B and 3B. In the tables, the new cubooctahedral morphologies are designated TCO and COT, whereas "tabular" indicates known tabular grain morphology. Halide ratios of the final grains were determined by neutron activation analysis. Grains from Samples 3, 19, 31, 37, 38 and 39 have been shown, in cross-sectioning, to contain both single and double parallel twin planes.

TABLE 1A

| | TABULAR GRAINS, PRECIPITATION CONDITIONS | | | | | | | | | |
|---|---|---|---|---|---|---|---|---|---|---|
| | NUCLEATION | | | TRANSITION | | | GROWTH | | | |
| | KETTLE NaX | | KETTLE | DUMP SALT, MOLES | | END | MOLES Ag/MIN | | RUN I | RUN Br/Cl |
| SAMPLE | X | MOLES | pAg | NaCl | NaBr | pAg | INITIAL | FINAL | moles | moles |
| 1 | Cl | .040 | 7.43 | 0 | .0535 | 8.92 | .040 | .091 | .091 | 3.5/0 |
| 2 | Br | .00012 | 7.57 | 0 | .0535 | 8.90 | .040 | .091 | .091 | 3.5/0 |
| 3 | Cl | .080 | 7.70 | 0 | .0535 | 8.86 | .038 | .091 | .091 | 3.5/0 |
| 4 | Br | .020 | 9.60 | 0 | .0535 | 9.04 | .038 | .091 | .092 | 3.5/0 |
| 5 | Br | .020 | 9.63 | .0535 | 0 | 8.46 | .038 | .091 | .092 | 3.5/0 |
| 6 | Br | .020 | 9.65 | .0535 | 0 | 8.48 | .038 | .091 | 0 | 3.5/0 |
| 7 | Cl | .040 | 7.44 | .0535 | .0200 | 8.52 | .038 | .091 | 0 | 3.5/0 |
| 8 | Cl | .040 | 7.52 | .0535 | .0150 | 8.37 | .045 | .091 | .092 | 3.5/0 |
| 9 | Cl | .040 | 7.49 | .0535 | .0085 | 8.24 | .045 | .091 | .092 | 3.5/0 |
| 10 | Cl | .040 | 7.49 | .0535 | .0025 | 7.87 | .045 | .091 | .092 | 3.5/0 |
| 11 | Cl | .040 | 7.46 | .0535 | .0015 | 7.77 | .045 | .091 | .092 | 3.5/0 |
| 12 | Cl | .040 | 7.47 | 0 | .0535 | 8.93 | .056 | .091 | 0 | 3.5/0 |
| 13 | Br | .020 | 9.52 | 0 | .0535 | 9.02 | .056 | .091 | 0 | 3.5/0 |
| 14 | Cl | .040 | 7.52 | 0 | .0535 | 8.92 | .056 | .091 | 0 | 2.8/.7 |
| 15 | Cl | .040 | 7.56 | .0535 | .0735 | 9.18 | .045 | .091 | .092 | 3.5/0 |
| 16 | Br | .020 | 9.50 | 0 | 0 | 7.56 | .038 | .091 | .075 | 2.8/.7 |
| 17 | Br | .080 | 9.50 | 0 | .0535 | 8.84 | .038 | .091 | .075 | 3.5/0 |
| 18 | Br | .020 | 9.55 | 0 | .0535 | 8.99 | .038 | .091 | .075 | 3.5/0 |

TABLE 1B

| | TABULAR GRAINS, EMULSION CHARACTERIST'CS | | | | | | |
|---|---|---|---|---|---|---|---|
| | EMULSION CHARACTERISTICS | | | | | | |
| | MOLE % | SIZING | | ASPECT | TABULARITY | % CUBICITY | |
| SAMPLE | Cl—Br—I | ECD | THICK | RATIO | ECD/(t*t) | TOTAL | EDGE |
| 1 | 0—96.9—3.1 | 1.03 | .050 | 20.60 | 412 | | |
| 2 | 0—97—3 | | | | | | |
| 3 | 0—95.5—4.5 | 1.40 | .065 | 21.54 | 331 | 1.5 | 17.7 |
| 4 | 0—97.1—2.9 | 1.35 | .045 | 30.00 | 667 | 1.7 | 27.2 |
| 5 | 2.1—95.0—2.9 | .871 | .068 | 12.81 | 188 | 7.3 | 54.1 |
| 6 | 1.4—98.6—0 | .935 | .054 | 17.31 | 321 | 4.2 | 40.6 |
| 7 | 0—100—0 | 1.08 | .047 | 22.98 | 489 | | |
| 8 | 1.9—95.2—2.9 | .921 | .065 | 14.17 | 218 | 4.6 | 37.2 |
| 9 | 2.3—94.9—2.8 | .789 | .068 | 11.60 | 171 | 4.3 | 29.2 |
| 10 | 3.4—93.6—3.0 | .540 | .127 | 4.25 | 33 | 6.2 | 19.4 |
| 11 | 2.8—94.3—2.9 | .515 | .130 | 3.96 | 30 | 5.8 | 17.3 |
| 12 | 0—100—0 | 1.36 | .053 | 25.66 | 484 | 2.8 | 38.7 |
| 13 | 0—100—0 | 1.16 | .050 | 24.17 | 503 | 2.6 | 34.0 |
| 14 | 1.6—98.4—0 | 1.28 | .058 | 22.07 | 380 | 2.3 | 27.7 |
| 15 | .5—96.3—3.2 | 1.50 | .051 | 29.41 | 577 | 1.5 | 23.6 |
| 16 | 10.7—86.8—2.5 | .537 | .119 | 4.51 | 38 | | |
| 17 | 0—97.5—2.5 | 2.020 | .053 | 37.97 | 714 | 1.6 | 32.0 |

TABLE 1B-continued

| TABULAR GRAINS, EMULSION CHARACTERISTICS | | | | | | | |
|---|---|---|---|---|---|---|---|
| EMULSION CHARACTERISTICS | | | | | | | |
| | MOLE % | SIZING | | ASPECT | TABULARITY | % CUBICITY | |
| SAMPLE | Cl—Br—I | ECD | THICK | RATIO | ECD/(t*t) | TOTAL | EDGE |
| 18 | 0—97.5—2.5 | .903 | .127 | 7.11 | 56 | 5.9 | 26.9 |

TABLE 2A

| CUBOOCTAHEDRAL-TABULAR GRAINS, PRECIPITATION CONDITIONS | | | | | | | | | | |
|---|---|---|---|---|---|---|---|---|---|---|
| | NUCLEATION | | | TRANSITION | | | GROWTH | | | |
| | KETTLE NaX | | KETTLE | DUMP SALT, MOLES | | END | MOLES Ag/MIN | | RUN I | RUN Br/Cl |
| SAMPLE | X | MOLES | pAg | NaCl | NaBr | pAg | INITIAL | FINAL | moles | moles |
| 19 | Cl | .040 | 7.46 | .0535 | 0 | 7.53 | .040 | .091 | .091 | 3.5/0 |
| 20 | Cl | .040 | 7.43 | .1070 | 0 | 7.63 | .038 | .091 | .130 | 3.5/0 |
| 21 | Cl | .080 | 7.72 | .0535 | 0 | 7.63 | .038 | .091 | .070 | 3.5/0 |
| 22 | Br | .040 | 7.47 | .0535 | 0 | 7.51 | .045 | .091 | .092 | 3.5/0 |
| 23 | Cl, Br | .04/.02 | 9.50 | .0535 | 0 | 7.57 | .045 | .091 | .092 | 3.5/0 |
| 24 | Cl | .020 | 7.10 | .0535 | 0 | 7.50 | .045 | .091 | .092 | 3.5/0 |
| 25 | Cl | .080 | 7.77 | .0535 | 0 | 7.65 | .038 | .091 | .092 | 3.5/0 |
| 26 | Cl | .080 | 7.80 | .0535 | 0 | 7.65 | .038 | .091 | 0 | 3.5/0 |
| 27 | Cl | .080 | 7.80 | .0535 | 0 | 7.72 | .038 | .091 | .009 | 3.5/0 |
| 28 | Cl | .080 | 7.80 | .1070 | 0 | 7.71 | .038 | .091 | .092 | 3.5/0 |
| 29 | Cl | .133 | 7.97 | 0 | 0 | 7.68 | .038 | .091 | .092 | 3.5/0 |
| 30 | Cl | .080 | 7.72 | .0535 | 0 | 7.62 | .038 | .091 | .075 | 2.8/.7 |
| 31 | Cl | .080 | 9.67 | .0535 | 0 | 7.17 | .038 | .091 | .086 | 3.5/0 |
| 32 | Br | .020 | 9.55 | 0 | .0535 | 9.01 | .038 | .091 | .075 | 3.5/0 |
| 33 | Br | .020 | 9.55 | 0 | .0535 | 9.01 | .038 | .091 | .075 | 3.5/0 |
| 34 | Br | .020 | 9.55 | 0 | .0535 | 9.01 | .038 | .091 | .075 | 3.5/0 |
| 35 | Br | .020 | 9.55 | 0 | .0535 | 9.01 | .038 | .091 | 0 | 3.5/0 |

TABLE 2B

| CUBOOCTAHEDRAL - TABULAR GRAINS, EMULSION CHARACTERISTICS | | | | | | | |
|---|---|---|---|---|---|---|---|
| EMULSION CHARACTERISTICS | | | | | | | |
| | MOLE % | SIZING | | ASPECT | TABULARITY | % CUBICITY | |
| SAMPLE | Cl—Br—I | ECD | THICK | RATIO | ECD/(t*t) | TOTAL | EDGE |
| 19 | 3.2—93.4—3.4 | .458 | .183 | 2.50 | 14 | | |
| 20 | 4.9—91.5—3.6 | | | | | | |
| 21 | 4.3—93.1—2.6 | .537 | .199 | 2.70 | 14 | 16 | 36.4 |
| 22 | 3.3—93.3—3.4 | .452 | .191 | 2.37 | 12 | | |
| 23 | 3.6—93.2—3.2 | .424 | .177 | 2.40 | 14 | | |
| 24 | | .487 | .190 | 2.56 | 13 | | |
| 25 | 4.4—92.8—2.8 | .561 | .186 | 3.02 | 16 | | |
| 26 | 5.4—94.6—0 | .615 | .195 | 3.15 | 16 | 12.5 | 32.2 |
| 27 | | .579 | .218 | 2.66 | 12 | 16.0 | 37.2 |
| 28 | 7.6—89.7—2.7 | .662 | .185 | 3.58 | 19 | 7.0 | 19.5 |
| 29 | 5.1—92.0—2.9 | .531 | .186 | 2.85 | 15 | 12.0 | 29.1 |
| 30 | 14.5—82.7—2.8 | .611 | .166 | 3.68 | 22 | 7.1 | 20.2 |
| 31 | 4.4—92.6—3 | .748 | .261 | 2.87 | 11 | 17.3 | 42.1 |
| 32 | 0—97.5—2.5 | .449 | .184 | 2.44 | 13 | | |
| 33 | 0—97.5—2.5 | .584 | .145 | 4.03 | 28 | 19.0 | 57.3 |
| 34 | 0—97.5—2.5 | .507 | .164 | 3.09 | 19 | 27.0 | 68.8 |
| 35 | 0—100—0 | .574 | .160 | 3.59 | 22 | | |

TABLE 3A

| CUBOOCTAHEDRAL GRAINS, PRECIPITATION CONDITIONS | | | | | | | | | | |
|---|---|---|---|---|---|---|---|---|---|---|
| | NUCLEATION | | | TRANSITION | | | GROWTH | | | |
| | KETTLE NaX | | KETTLE | DUMP SALT, MOLES | | END | MOLES Ag/MIN | | RUN I | RUN Br/Cl |
| SAMPLE | X | MOLES | pAg | NaCl | NaBr | pAg | INITIAL | FINAL | moles | moles |
| 36 | Cl | .040 | 7.46 | 0 | 0 | 7.47 | .045 | .091 | .092 | 3.5/0 |
| 37 | Br | .020 | 9.60 | 0 | 0 | 7.51 | .038 | .091 | .092 | 3.5/0 |
| 38 | Cl | .040 | 7.44 | .0535 | 0 | 7.57 | .056 | .091 | 0 | 3.5/0 |
| 39 | Cl | .040 | 7.44 | .0535 | 0 | 7.56 | .056 | .091 | 0 | 3.5/0 |
| 40 | Cl | .080 | 7.70 | .0535 | 0 | 7.60 | .056 | .091 | 0 | 3.5/0 |
| 41 | Cl | .040 | 7.46 | .1070 | 0 | 7.65 | .056 | .091 | 0 | 3.5/0 |
| 42 | Cl | .040 | 7.44 | .0535 | 0 | 7.54 | .100 | .142 | .142 | 3.5/0 |
| 43 | Br | .020 | 9.55 | 0 | 0 | 7.54 | .056 | .091 | 0 | 3.5/0 |
| 44 | Cl | .040 | 7.38 | .0535 | 0 | 7.48 | .100 | .142 | .143 | 5.14/.3 |

TABLE 3B

| CUBOOCTAHEDRAL GRAINS, EMULSION CHARACTERISTICS | | | | |
|---|---|---|---|---|
| | EMULSION CHARACTERISTICS | | | |
| SAMPLE | FINAL MORPHOLOGY | MOLE % Cl—Br—I | SIZING ESD | % CUBICITY TOTAL |
| 36 | TCO | 1.9—94.9—3.2 | | |
| 37 | TCO | 0—96.6—3.4 | .192 | |
| 38 | TCO | 1.2—98.8—0 | .382 | 39.0 |
| 39 | TCO | 2.7—97.3—0 | .331 | 51.5 |
| 40 | COT + TCO | 4.6—95.4—0 | | 15.5 |
| 41 | COT + TCO | | | |
| 42 | TCO | 2.0—95.1—2.9 | .241 | 48.0 |
| 43 | TCO | 0—100—0 | .255 | |
| 44 | TCO | 7.3—89.7—3 | .245 | |

In Table 3B, ESD refers to equivalent spherical diameter.

Three of the emulsions prepared above were coated onto photographic supports and tested for speed and gamma properties. Speed was determined at 0.15 density over fog. Each emulsion had the same percent surface coverage of dye and was separately optimized for chemical sensitizer level. The results are set forth in Table 4 below. In Table 4, total mole % Cl is the amount of chloride present during precipitation, but little if any chloride was incorporated into the final tabular grains.

TABLE 4

| Sample | Total Mole % Cl | ECD | Thickness | Speed | Gamma |
|---|---|---|---|---|---|
| 4 | 0.00 | 1.35 | 0.050 | 179 | 3.05 |
| 12 | 1.31 | 1.36 | 0.053 | 189 | 3.00 |
| 15 | 3.07 | 1.50 | 0.051 | 194 | 2.92 |

These results illustrate that grains made according to the method of the invention display good photographic properties.

It will be understood that the foregoing description is of preferred exemplary embodiments of the invention, and that the invention is not limited to the specific forms shown. Modifications may be made in the procedures of the invention without departing from the scope of the invention as expressed in the appended claims.

I claim:

1. A process for preparing a photographic emulsion, comprising the steps of:

(A) reacting a first silver salt with a bromide in the presence of a first, excess halide in the presence of a peptizing medium and under conditions of silver and halide concentration and rate of addition, pH, temperature and reaction time effective to nucleate AgBr crystals having twin planes, the first halide remaining in solution; and then (B) growing the crystals in an aqueous solution to form photosensitive grains by addition of a second silver salt and a second halide while maintaining a silver concentration in the growth solution sufficiently high to produce twinned cubooctahedral or cubooctahedral tabular grains having 1.1.1 and 1.0.0 edge structure.

2. The process of claim 1, wherein pAg during the growth step is maintained in the range of about 8.1 or less at 60° C.

3. The process of claim 1, further comprising a step of coating the photosensitive grains onto a support in the presence of a gel medium to form a photosensitive element.

4. The process of claim 1, wherein the first halide is a chloride, the amount of chloride in the nucleation step is in the range of about 0.35 to 2.5 g/l, and the amount of bromide is less than an excess amount relative to silver.

5. The process of claim 1, wherein pAg during the growth step is maintained at a level effective to produce said twinned cubooctahedral grains.

6. The process of claim 1, wherein pAg during the growth step is maintained at a level effective to produce said twinned cubooctahedral tabular grains.

7. The process of claim 4, wherein the first and second silver salts are $AgNO_3$, the bromide is NaBr, the chloride is NaCl, and the second halide is selected from NaI, NaCl, NaBr, and combinations thereof.

8. The process of claim 1, wherein the first and second halides, which may be the same or different, are each selected from sodium, potassium, cesium, and ammonium salts of chlorine, bromine, and iodine, and combinations thereof.

9. The process of claim 1, wherein said step (A) further comprises:

forming an aqueous solution containing an acid, a peptizing medium, and a chloride or bromide salt as the excess halide;

heating the resulting mixture to a temperature in the range of about 35° C. to 60° C.; and then adding the first silver salt and a bromide salt to said mixture to form the silver nuclei.

10. The process of claim 9, wherein said step (B) further comprises:

heating the mixture to a temperature in the range of about 45° C. to 70° C.;

adjusting pH of the mixture to less than 6;

gradually adding the second silver salt and second halide at concentrations effective to enlarge the silver bromide nuclei in the mixture.

11. An emulsion prepared by the process of claim 1.

12. A process for preparing a photographic emulsion, comprising the steps of:

(A) reacting a first silver salt with a bromide in the presence of excess chloride in the presence of a peptizing medium and under conditions of silver and halide concentration and rate of addition, pH, temperature and reaction time effective to nucleate essentially pure AgBr crystals; and (B) then growing the crystals in the absence of substantial amounts of excess chloride to form photosensitive grains by addition of a second silver salt and a halide.

13. The process of claim 12, wherein the chloride in step (A) is present in an amount effective to obtain a pCl in the range of 2.22 to 1.37.

14. The process of claim 12, wherein said step (A) further comprises:

forming an aqueous solution containing an acid, a peptizing medium, and a chloride salt in an amount effective to obtain a pCl of 3 or less;

heating the resulting mixture to a temperature in the range of about 35° C. to 60° C.;

then adding the first silver salt and a bromide salt to said mixture to form the silver nuclei; and waiting for a time sufficient to allow the silver nuclei to form.

15. The process of claim 14, wherein said step (B) further comprises:

heating the mixture to a temperature in the range of about 45° C. to 70° C.;

adjusting pH of the mixture to less than 6; and gradually adding the second silver salt and second halide at concentrations effective to enlarge the silver bromide nuclei in the mixture.

16. The process of claim 15, wherein the first and second silver salts are $AgNO_3$, the bromide is NaBr, the chloride is NaCl, and the halide is selected from NaI, NaCl, NaBr, and combinations thereof.

17. The process of claim 12, wherein pAg during the growth step is controlled in the range of about 8.5 down to 7.9, resulting in tabular grains having an aspect ratio in the range of about 5:1 to 20:1.

18. The process of claim 12, wherein pAg during the growth step is 7.9 or less, resulting in tabular grains having an aspect ratio of about 5:1 or less.

19. The process of claim 12, wherein pAg during the growth step is greater than about 8.5, resulting in tabular grains having an aspect ratio greater than about 20:1.

20. A silver halide in the form of twinned, cubooctahedral grains having double, parallel twin planes.

21. A silver halide in the form of twinned, cubooctahedral tabular grains having an edge structure comprising alternating 1.0.0 and 1.1.1 crystal faces.

22. In a photosensitive element including a photosensitive silver halide disposed on a support, the improvement wherein the silver halide comprises twinned, cubooctahedral silver halide grains having double, parallel twin planes.

23. In a photosensitive element including a photosensitive silver halide disposed on a support, the improvement wherein the silver halide comprises twinned, cubooctahedral tabular grains having an edge structure comprising alternating 1.0.0 and 1.1.1 crystal faces.

24. The silver halide of claim 20, wherein the twinned, cubooctahedral grains have a tabularity less than about 1 and have from 35 to 80% 1.0.0 surface area and 20 to 65% 1.1.1 surface area.

25. The silver halide of claim 20, wherein the wherein the halide consists essentially of bromide with up to 3.4 mol. % iodide.

26. The silver halide of claim 24, wherein the grain contains from about 89.7 to 100% mol. % Br, up to 7.3 mol. % Cl, and up to 3.4 mol % I.

27. The silver halide of claim 20, wherein the grains are made from AgBr nuclei.

28. The silver halide of claim 21, wherein the cubooctahedral tabular grains have from 7 to 35% 1.0.0 surface area and 65 to 93% 1.1.1 surface area, a tabularity less than about 25, a percent edge cubicity in the range of from about 19% to 70%, and an aspect ratio in the range of from about 2 to 8.

29. The silver halide of claim 21, wherein the grains are made from AgBr nuclei.

30. The silver halide of claim 21, wherein the halide consists essentially of bromide with up to 3.6 mol. % iodide.

31. The silver halide of claim 28, wherein the grain contains from about 82.7 to 100% mol. % Br, up to 14.5 mol % Cl and up to 3.6 mol % I.

32. The photosensitive element of claim 22, wherein the twinned, cubooctahedral grains have a tabularity less than about 1 and have from 35 to 80% 1.0.0 surface area and 20 to 65% 1.1.1 surface area, and wherein the grains contain from about 89.7 to 100% mol % Br, up to 7.3 mol. % Cl, and up to 3.4 mol. % I.

33. The photosensitive element of claim 23, wherein the cubooctahedral tabular grains have from 7 to 35% 1.0.0 surface area and 65 to 93% 1.1.1 surface area, a tabularity less than about 25, a percent edge cubicity in the range of from about 19% to 70%, an aspect ratio in the range of from about 2 to 8, and wherein the grains contain from about 82.7 to 100% mol. % Br, up to 14.5 mol. % Cl and up to 3.6 mol. % I.

34. The photosensitive element of claim 22, wherein the grains are made from AgBr nuclei.

35. The photosensitive element of claim 23, wherein the grains are made from AgBr nuclei.

36. The process of claim 1, wherein the first excess halide in step (A) is chloride or bromide and is present in an amount effective to obtain a pCl or pBr in the range of about 1 to 2.

37. The process of claim 7, wherein the second halide consists essentially of silver bromide, and step (B) is conducted in the presence of a peptizing medium and under conditions of silver and halide concentration and rate of addition, pH, temperature and reaction time effective to provide substantially uniform growth.

* * * * *